US006838049B2

(12) United States Patent
Fukuzumi et al.

(10) Patent No.: US 6,838,049 B2
(45) Date of Patent: Jan. 4, 2005

(54) ROOM-TEMPERATURE-FORMABLE MAGNESIUM ALLOY WITH EXCELLENT CORROSION RESISTANCE

(75) Inventors: Tatsuo Fukuzumi, Tokyo (JP); Kazunari Suemune, Utsunomiya (JP); Susumu Takahashi, Utsunomiya (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/499,932

(22) PCT Filed: Oct. 30, 2003

(86) PCT No.: PCT/JP03/13948

§ 371 (c)(1),
(2), (4) Date: Jun. 18, 2004

(87) PCT Pub. No.: WO2004/042099

PCT Pub. Date: May 21, 2004

(65) Prior Publication Data

US 2004/0247480 A1 Dec. 9, 2004

(30) Foreign Application Priority Data

Nov. 6, 2002 (JP) ..... 2002-322180

(51) Int. Cl.[7] ..... C22C 23/00

(52) U.S. Cl. ..... 420/412; 420/411; 148/420

(58) Field of Search ..... 420/411, 412; 148/420

(56) References Cited

FOREIGN PATENT DOCUMENTS

| | | |
|---|---|---|
| JP | 52-119409 | 10/1977 |
| JP | 06-065668 | 3/1996 |
| JP | 9-41066 | 2/1997 |
| JP | 2001-107171 | 4/2001 |
| JP | 2001-247925 | 9/2001 |

*Primary Examiner*—Sikyin Ip
(74) *Attorney, Agent, or Firm*—Flynn, Thiel, Boutell & Tanis, P.C.

(57) ABSTRACT

A magnesium alloy with formability at room temperature and excellent corrosion resistance is provided. Specifically, a magnesium alloy is provided which comprises, in mass %, 8.0 to 11.0% Li, 0.1 to 4.0% Zn, and 0.1 to 4.5% Ba, with the balance being Mg and unavoidable impurities, the alloy which further comprises 0.1 to 0.5% Al, and the alloy which further comprises 0.1 to 2.5% Ln (a total amount of one or more lanthanoids) and 0.1 to 1.2% Ca.

3 Claims, No Drawings

ROOM-TEMPERATURE-FORMABLE MAGNESIUM ALLOY WITH EXCELLENT CORROSION RESISTANCE

This application is a 371 of PCT/JP03/13948 filed Oct. 30, 2003.

TECHNICAL FIELD

The present invention relates to a magnesium alloy with a high specific strength which is suitable for automobile parts, various household electric appliances, and various OA devices, more particularly to a magnesium alloy with room-temperature formability and excellent corrosion resistance.

BACKGROUND ART

Magnesium alloys have attracted attention as alloys for practical use because they have a small weight and excellent electromagnetic shielding properties, machinability, and recyclability, but they are known to have resistance to plastic processing at room temperature. For this reason, the conventional magnesium alloys that have been used, for example, for press forming had to be formed at an elected temperature (150 to 350° C.). From the standpoint of operability, safety, and cost, it was also desired that materials with formability at room temperature be developed.

Mg is considered to have poor formability because it has a hexagonal closest packed crystal structure (h. c. p.) with few slip planes during plastic deformation. Accordingly, attempts have been made to increase formability by changing the crystal structure (increasing the number of slip planes) by means of adding various alloying elements to Mg.

Among the alloys thus obtained, an Mg—Li eutectic alloy is an alloy in which a P-phase, which has a body centered cubic crystal structure (b. c. c.) with a solid solution of Li in Mg is precipitated by adding Li in an amount of no less than 6%, and formability is thereby increased. Such Mg—Li eutectic alloys can be subjected to forming at room temperature and this specific feature of the alloys offers strong possibility for new processing methods.

However, though such Mg-Li eutectic alloys have excellent room-temperature formability, the drawback thereof is that the increase in formability is accompanied by the decrease in tensile strength and that the addition of active elements Li decreases corrosion resistance. When a large amount of Al, Zn, or the like is added to improve the tensile strength and corrosion resistance, the room-temperature formability, which is a specific feature of the alloy, is lowered as a significant adverse effect.

As for the tensile strength, it was suggested to increase strength and improve strength stability by adding Y to Mg—Li alloys (Japanese Patent Publication No. 8-23057B), but using Y, which is an active element similarly to Li, naturally failed to solve the problems associated with corrosion resistance.

Furthermore, the increase in tensile strength in alloys obtained by adding Ag to Mg—Li eutectic alloys has also been reported, but using expensive material such as Ag is undesirable because of increased production cost of the alloys.

DISCLOSURE OF THE INVENTION

The present invention provides a magnesium alloy with formability at room temperature and excellent corrosion resistance.

The present invention consists of the following aspects (1) to (3).

(1) A magnesium alloy with formability at room temperature and excellent corrosion resistance, comprising, in mass %, 8.0 to 11.0% Li, 0.1 to 4.0% Zn, and 0.1 to 4.5% Ba, with the balance being Mg and unavoidable impurities.

(2) The magnesium alloy with formability at room temperature and excellent corrosion resistance, according to the above (1), further comprising, in mass %, 0.1 to 0.5% Al.

(3) The magnesium alloy with formability at room temperature and excellent corrosion resistance, according to the above (1) or (2), further comprising, in mass %, 0.1 to 2.5% Ln (a total amount of one or more lanthanoids) and 0.1 to 1.2% Ca.

The reasons for limiting the contents of the respective components in accordance with the present invention are will described below. All percents hereinbelow are by mass.

Li: Li has to be present at no less than 8.0% to modify the crystal structure (h. c. p.) of Mg and provide it with formability. On the other hand, when Li is added in an amount of above 11.0%, though the structure becomes a b. c. c. single phase and the formability at room temperature is improved, the corrosion resistance is degraded. Accordingly a range of 8.0 to 11% is selected for Li based on the results of tensile strength and corrosion resistance tests.

Zn: Zn is an element improving the corrosion resistance and strength, but it also degrades the formability. Therefore, in order to obtain formability at room temperature, it is undesirable that this element be added in a large amount.

On the other hand, the results of microstructure observations demonstrated that in an alloy obtained by adding 2% Zn to a Mg—Li eutectic alloy, the amount of an $\alpha$-phase (h. c. p. Mg phase) adversely affecting formability was decreased. Accordingly a range of 0.1 to 4.0% is selected for Zn, based on the results of compression, tensile, and corrosion tests.

Ba: Ba has a b. c. c. structure, but has a low solubility limit in Mg and forms an intermetallic compound ($Mg_{17}Ba_2$) with Mg. Because $Mg_{17}Ba_2$ precipitates at a temperature of 634° C. which is close to 588° C., which is the Mg—Li eutectic reaction temperature, but higher than this reaction temperature, it acts as a nucleus when the $\alpha$-and $\beta$-phases precipitate, providing for refinement and uniform dispersion of $\alpha$- and $\beta$-phases. However, because $Mg_{17}Ba_2$ has a h. c. p. structure, if its content increases, the adverse effect thereof on formability can be a concern. Accordingly, a range of 0.1 to 4.5% is selected for Ba based on the results relating to tensile strength.

The reason for adding Al in the above (2) will be described below.

Al: Al is an element greatly improving corrosion resistance and strength. However, the increase in strength is also accompanied by a significant reduction in formability. Therefore, in order to obtain formability at room temperature, it is undesirable that this element be added in a large amount. Thus, based on the corrosion test results, a lower limit is set to 0.1% according to the corrosion resistance improvement effect, and based on the tensile test (elongation) result, 0.5% representing the range where formability at room temperature is demonstrated is set as an upper limit.

The reasons for limiting the contents of Ln and Ca in the above (3) will be described below.

Ln: Ln (La, Ce, misch metal, and the like) is an element improving corrosion resistance and heat resistance, but at the same time producing an adverse effect decreasing the tensile strength. Another undesirable feature is that because it is an expensive material, using it in a large amount raises the production cost of the alloy. Accordingly, a range of 0.1 to 2.5% is selected for Ln based on the tensile test results.

Ca: Ca is an element improving tensile strength, but because it also produces an adverse effect decreasing corrosion resistance, using this element in a large amount is undesirable. Thus, based on the tensile test results, a lower limit is set to 0.1% according to the strength improvement effect, and based on the corrosion test results, the upper limit is set to 1.2.

In accordance with the present invention, selecting the above-described content range for each element makes it possible to provide a magnesium alloy with formability at room temperature and excellent corrosion resistance.

BEST MODE FOR CARRYING OUT THE INVENTION

The present invention will be described below in greater detail based on specific embodiments thereof.

Alloys with compositions shown in Table 1 were melted in a high-frequency induction melting furnace with argon atmosphere adjusted to 102 to 103 kPa. Melting used a stainless steel crucible and no flux was employed. Test ingots were produced by casting the melts into a 250 mm×300 mm×30 $mm^t$ die. Test pieces were sampled from the ingots and microstructure observations were conducted.

Test pieces: 10 mm×10 mm×5 $mm^t$ (cross section in the casting direction was mirror polished).

Heat treatment: none (as cast).

Etching conditions: etching for 10 seconds in Nitral solution, washing and then drying.

The test pieces were then rolled to a thickness of 0.6 $mm^t$ and subjected to: (1) tensile test and (2) corrosion resistance test.

(1) Tensile test conditions

Apparatus: Shimazu Autograph (AJ-100 kNB).

Test pieces:

thickness: 0.6 $mm^t$, width between gauge marks: 5 mm, gauge length: 40 mm

[test pieces with a size of 8/12.5 that of test piece 13B specified by JIS (Japanese Industrial Standard) Z2201, sampled from the rolling direction].

Heat treatment conditions: none (as rolled).

Atmosphere: room temperature, in air.

Tension speed: 2 mm/min (initial strain rate: $8.3\times10^{-4}S^{-1}$).

Evaluation items: tensile strength, and elongation.

(2) Corrosion resistance test conditions

Apparatus: salt spray test apparatus, manufactured by Suga Test Instruments Co., Ltd.

Test piece: 60 mm×120 mm×0.6 $mm^t$.

Heat treatment conditions: none (as rolled).

Sprayed solution: 35° C., 5% aqueous solution of NaCl.

Spraying pressure: 1 $kgf/cm^2$.

Evaluation: corrosion damage zone (corrosion reaction zone) was removed, the surface area of damage zone was measured.

The measurement results obtained in the tensile test and corrosion test are shown in Table 1.

The symbol "Ln" in Table 1 that was used in the present embodiments was a material comprising no less than 95% of the total Ce and La, the balance being other elements of lanthanoid series.

TABLE 1

Compositions of developed materials and comparative materials and results of tensile test and corrosion resistance test

| | | Composition | | | | | | | | Tensile test (room temperature) | | Corrosion test Percentage of |
|---|---|---|---|---|---|---|---|---|---|---|---|---|
| | No. | Li | Zn | Ba | Al | Ln | Ca | Mn | Mg | Elongation, % | Strength, $N/mm^2$ | surface area of damage zone, % |
| Developed materials | 1 | 9.6 | 2.1 | 0.1 | | | | | Bal. | 26 | 171 | 3 |
| | 2 | 9.7 | 4.0 | 0.3 | | | | | Bal. | 25 | 177 | 2 |
| | 3 | 9.5 | 1.9 | 0.8 | | | | | Bal. | 25 | 162 | 3 |
| | 4 | 9.5 | 1.9 | 1.9 | | | | | Bal. | 25 | 143 | 3 |
| | 5 | 9.6 | 1.7 | 4.1 | | | | | Bal. | 25 | 165 | 2 |
| | 6 | 9.5 | 1.9 | 0.1 | 0.1 | | | | Bal. | 26 | 176 | 3 |
| | 7 | 9.6 | 1.8 | 0.2 | 0.5 | | | | Bal. | 25 | 176 | 2 |
| | 8 | 9.6 | 2.0 | 0.1 | | 0.1 | | | Bal. | 26 | 169 | 2 |
| | 9 | 9.5 | 1.8 | 0.3 | | 0.9 | | | Bal. | 29 | 163 | 8 |
| | 10 | 9.6 | 1.8 | 0.2 | | 2.2 | | | Bal. | 34 | 143 | 13 |
| | 11 | 9.6 | 1.8 | 0.2 | 0.2 | 0.5 | | | Bal. | 25 | 172 | 5 |
| | 12 | 9.4 | 1.9 | 0.1 | | | 0.1 | | Bal. | 26 | 178 | 5 |
| | 13 | 9.6 | 1.8 | 0.3 | | | 1.2 | | Bal. | 31 | 176 | 15 |
| | 14 | 9.6 | 2.0 | 0.3 | 0.2 | | 0.5 | | Bal. | 29 | 171 | 7 |
| | 15 | 9.4 | 1.8 | 0.2 | 0.1 | 0.3 | 0.3 | | Bal. | 27 | 176 | 9 |
| Comparative materials | 1 | 7.9 | | | | | | | Bal. | 21 | 226 | 23 |
| | 2 | 11.2 | | | | | | | Bal. | 39 | 104 | 20 |
| | 3 | | 0.8 | | 3.0 | | | 0.8 | Bal. | 4 | 246 | 15 |

INDUSTRIAL APPLICABILITY

The magnesium alloy in accordance with the present invention can be subjected to forming at room temperature and is excellent in corrosion resistance. In particular, the present invention provides a magnesium alloy with a high specific strength which is suitable for automobile parts, various household electric appliances, and various

What is claimed is:

1. A magnesium alloy with formability at room temperature and excellent corrosion resistance, comprising, in mass %, 8.0 to 11.0% Li, 0.1 to 4.0% Zn, and 0.1 to 4.5% Ba, with the balance being Mg and unavoidable impurities.

2. The magnesium alloy with formability at room temperature and excellent corrosion resistance, according to claim 1, further comprising, in mass %, 0.1 to 0.5% Al.

3. The magnesium alloy with formability at room temperature and excellent corrosion resistance, according to claim 1, further comprising, in mass %, 0.1 to 2.5% Ln (a total amount of one or more lanthanoids) and 0.1 to 1.2% Ca.

* * * * *